US006793255B2

(12) United States Patent
Kobayashi et al.

(10) Patent No.: US 6,793,255 B2
(45) Date of Patent: Sep. 21, 2004

(54) DOOR LOCKING APPARATUS FOR VEHICLE

(75) Inventors: Fumio Kobayashi, Kanagawa-ken (JP); Ryoji Shimura, Kanagawa-ken (JP)

(73) Assignee: Ohi Seisakusho Co., Ltd., Kanagawa-ken (JP)

( * ) Notice: Subject to any disclaimer, the term of this patent is extended or adjusted under 35 U.S.C. 154(b) by 0 days.

(21) Appl. No.: 10/146,874

(22) Filed: May 15, 2002

(65) Prior Publication Data

US 2002/0171250 A1 Nov. 21, 2002

(30) Foreign Application Priority Data

May 15, 2001 (JP) ..... P2001-145499

(51) Int. Cl.[7] ..... E05C 3/06
(52) U.S. Cl. ..... 292/216; 292/336.3; 292/DIG. 25
(58) Field of Search ..... 292/216, DIG. 25, 292/336.3

(56) References Cited

U.S. PATENT DOCUMENTS 3,840,258 A * 10/1974 Brackmann ..... 292/216
3,858,919 A * 1/1975 Kleefeld et al. ..... 292/216
4,850,625 A * 7/1989 Hori et al. ..... 292/336.3
5,263,347 A * 11/1993 Allbaugh et al. ..... 70/257
5,676,003 A * 10/1997 Ursel et al. ..... 70/472
5,802,894 A * 9/1998 Jahrsetz et al. ..... 70/264
5,901,991 A * 5/1999 Hugel et al. ..... 292/201
5,971,449 A * 10/1999 Rogers et al. ..... 292/216
6,158,788 A * 12/2000 Ikeda et al. ..... 292/216
6,367,296 B1 * 4/2002 Dupont ..... 70/257

* cited by examiner

*Primary Examiner*—Robert J. Sandy
*Assistant Examiner*—Carlos Lugo
(74) *Attorney, Agent, or Firm*—Brenda O. Holmes; Kilpatrick Stockton LLP

(57) ABSTRACT

A door locking apparatus for a vehicle including: a first locking/unlocking mechanism driven by a first driving mechanism operable by a knob inside a car and a control switch, and switchable between an unlocked state where operations of inside and outside handles respectively provided inside and outside the car are effective, and a locked state where the operation of the outside handle is ineffective while that of the inside handle being effective; a second locking/unlocking mechanism driven by a second driving mechanism operable by the control switch, and switchable between an unlocked state where the operation of the inside handle is effective, and a locked state where the operation thereof is ineffective; and a third locking/unlocking mechanism switchable between an unlocked state for enabling a transmission of an unlocking force from the knob to the first locking/unlocking mechanism, and a locked state for disabling the transmission thereof.

4 Claims, 10 Drawing Sheets

DOOR LOCKING APPARATUS FOR VEHICLE

BACKGROUND OF THE INVENTION

1. Field of the Invention

The present invention relates to a door locking apparatus for a vehicle with an antitheft feature.

2. Description of the Related Art

There has been a door locking apparatus for a vehicle with a locking/unlocking mechanism. Specifically, the locking/unlocking mechanism enables an unlocked state where door opening operations of an outside handle installed outside a car door and an inside handle installed inside a car are effective by operating a key cylinder provided outside the car door, a locking/unlocking knob inside the car, or an electric-powered actuator, and has a so-called override operation capability enabling a locked state where the door opening operation of the outside handle is ineffective while that of the inside handle is effective.

The encountered problem in the above-described door locking apparatus for a vehicle, however, is that the inside handle and the locking/unlocking knob can be illegally operated from outside the car, and the door is opened, even when the locking/unlocking mechanism is in the locked state.

SUMMARY OF THE INVENTION

The object of the present invention is to provide a door locking apparatus for a vehicle, which is adapted to prevent a door from being opened even when an inside handle and a locking/unlocking knob are illegally operated.

The first aspect of the present invention is a door locking apparatus for a vehicle, comprising: a first driving mechanism operable by a knob provided inside a car and a control switch; a first locking/unlocking mechanism driven by the first driving mechanism, being switchable between an unlocked state where operations of an outside handle provided outside the car and an inside handle provided inside the car are effective, and a locked state where the operation of the outside handle is ineffective while the operation of the inside handle being effective; a second driving mechanism operable by the control switch; a second locking/unlocking mechanism driven by the second driving mechanism, being switchable between an unlocked state where the operation of the inside handle is effective, and a locked state where the operation of the inside handle is ineffective; and a third locking/unlocking mechanism being switchable between an unlocked state for enabling a transmission of an operating force for unlocking from the knob to the first locking/unlocking mechanism, and a locked state for disabling the transmission thereof.

According to the first aspect constituted as described above, by setting all the first, second and third locking/unlocking mechanisms in locked states, the door opening operations of the outside and inside handles, and the unlocking operation of the knob are ineffective, thus, surely preventing illegal door opening.

A second aspect of the present invention is the door locking apparatus for a vehicle according to the first aspect, in which the first driving mechanism comprises: a first motor operable by the control switch; and a first driving lever connected to the first locking/unlocking mechanism, being operated by one of the first motor and a knob lever connected to the knob and movable between an unlocking position for setting the first locking/unlocking mechanism in the unlocked state and a locking position for setting the first locking/unlocking mechanism in the locked state, the second driving mechanism comprises: a second motor operable by the control switch; and a second driving lever connected to the second locking/unlocking mechanism, being operated by the second motor and movable between an unlocking position for setting the second locking/unlocking mechanism in the unlocked state and a locking position for setting the second locking/unlocking mechanism in the locked state, and the third locking/unlocking mechanism is attached to the first driving lever and is capable of being switched between the unlocked and locked state by the second driving lever.

According to the second aspect constituted as described above, the second and third locking/unlocking mechanisms can be switched between the locked and unlocked states almost simultaneously by the second motor, thus simplifying a configuration thereof and enabling quick double locking operation.

A third aspect of the present invention is the door locking apparatus for a vehicle according to the second aspect, in which the first driving lever can be moved from the locking position to the unlocking position by a key cylinder provided outside the car, and the moved first driving lever can switch the second locking/unlocking mechanism from the locking position to the unlocking position.

According to the third aspect constituted as described above, even when the first and second motors are not available due to the dead battery or the like, the double-locked state can be released by the unlocking operation of the key cylinder outside the car, thus, enhancing its safety.

A fourth aspect of the present invention is the door locking apparatus for a vehicle according to the second aspect, in which the knob lever is configured with a connecting portion for being connected to the first driving lever, the third locking/unlocking mechanism is configured with an engaging portion to be engaged with the connecting portion, and in an unlocking operation of the knob, with the third locking/unlocking mechanism in the unlocked state, the connecting portion is engaged with the engaging portion to move the first driving lever from the locking position to the unlocking position, and with the third locking/unlocking mechanism in the locked state, the connecting portion is not engaged with the engaging portion so that the first driving lever is disabled from moving from the locking position to the unlocking position.

According to the fourth aspect constituted as described above, in the double-locked state, the unlocking operation of the knob fails even when it is illegally operated, thus preventing damaging or the like.

A fifth aspect of the, present invention is the door locking apparatus for a vehicle according to the second aspect, in which the knob lever is configured with a connecting portion for being connected to the first driving lever, and the third locking/unlocking mechanism comprises: a first lever pivotally attached to the first driving lever, having an engaging portion provided in an end thereof to be engaged with the connecting portion of the knob lever, and being movable between an unlocking position for enabling the engaging portion to be engaged with the connecting portion of the knob lever and a locking position for disabling the engagement, a second lever pivotally attached to the first driving lever, having a connection portion to be connected to the second driving lever, and being coupled to the first lever so that the second driving lever can move from the locking position to the unlocking position even when the first lever is in the locking position, and a spring provided between the first and second levers, for pressing the first lever from the locking position to the unlocking position.

According to the fifth aspect constituted as described above, in the double-locked state, even when the knob is illegally operated for unlocking, the double-locked state can be released, and erroneous operations can be surely prevented.

BRIEF DESCRIPTION OF THE DRAWINGS

The invention will now be described with reference to the accompanying drawings, wherein.

DETAILED DESCRIPTION OF THE PREFERRED EMBODIMENTS

An embodiment of the present invention will be explained below with reference to the drawings. Note that, in FIGS. 2 and 3, "rear" and "front" of a vehicle are on left and right sides, respectively, and, in FIG. 4, "inside a car/inner", and "outside a car/outer" are on left and right sides, respectively.

Figure 1:
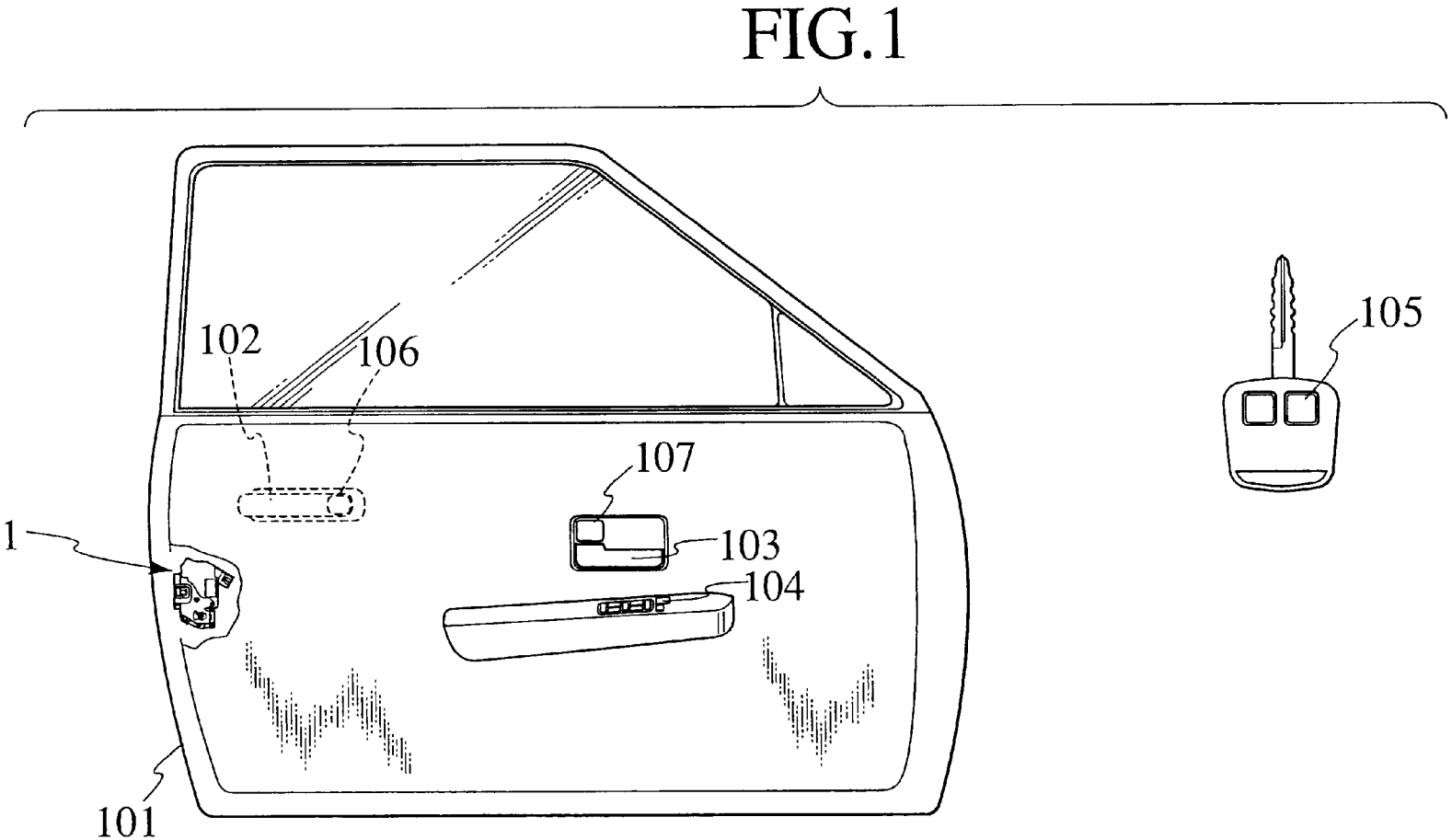
FIG. 1 is an explanatory side view of a car door viewed from an inside of a car, showing a door locking apparatus according to an embodiment of the present invention being mounted thereto.

A door lock assembly 1 is fixed to a side panel of a car door 101 of the vehicle by bolts (not shown), as shown in FIG. 1. Inside a body 2 of the door lock assembly 1, a latch (not shown) for engaging/disengaging with a striker (not shown) fixed to a car body at opening/closing the door 101, and an engaging member (not shown) which prevents rotation of the latch by engaging therewith and holds the door 101 in its closed state, are rotatably housed to constitute an engaging mechanism.

Figure 4:
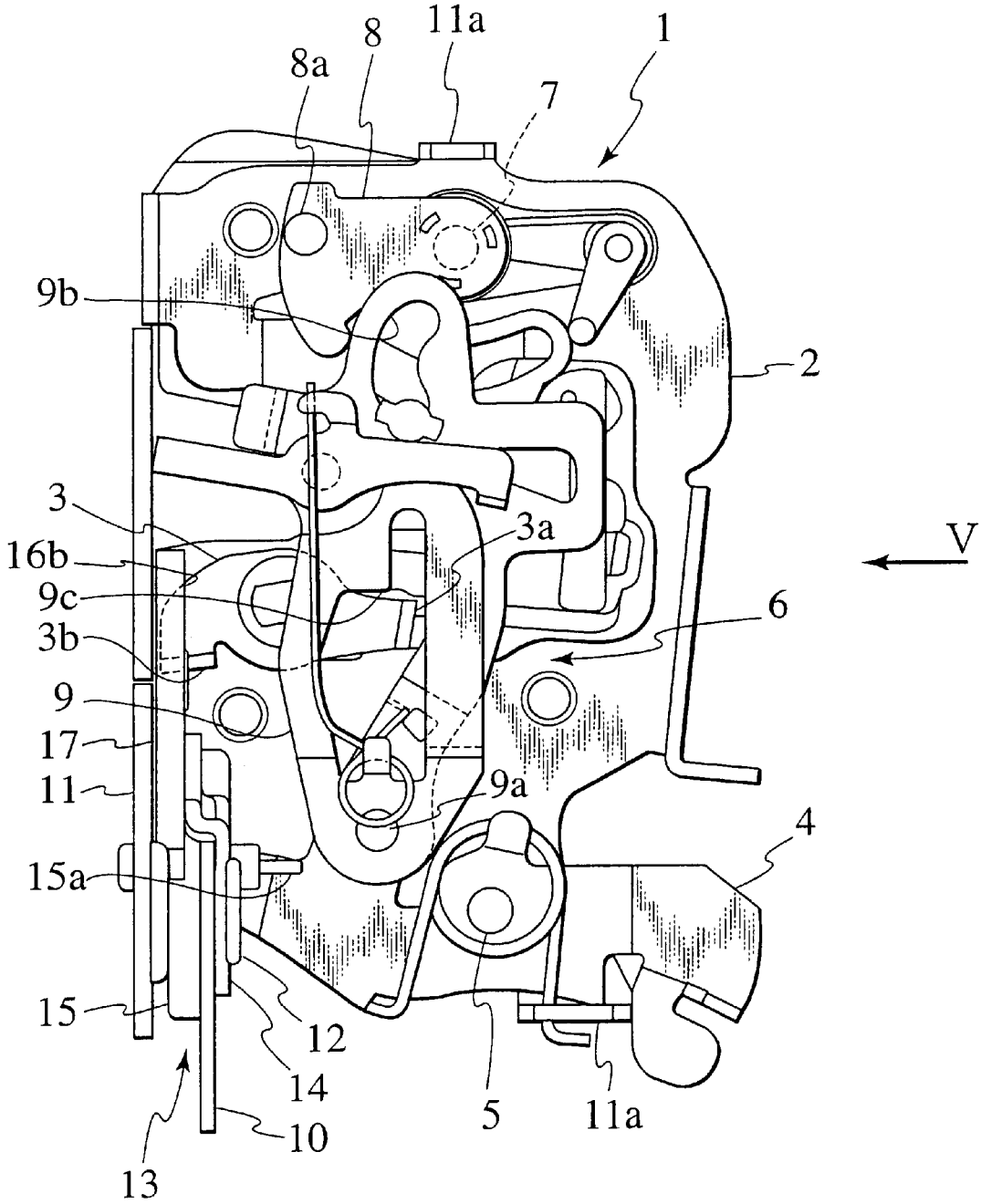
FIG. 4 is a front view of the door lock assembly showing a first locking/unlocking mechanism in its locked state.

In FIG. 4, an open lever 3 is pivotally attached to the body 2 and is capable of rotating integrally with the engaging member. By rotating the open lever 3 in an opening direction (clockwise direction in FIG. 4), the engaging member is disengaged from the latch and the door 101 can be opened.

An outside lever 4 is pivotally attached to a lower part of the body 2 by a shaft 5. An outer end of the outside lever 4 is connected through a cable (not shown) to an outside handle 102 provided outside the car door 101. The outside lever 4 is rotated in an opening direction (counterclockwise direction in FIG. 4) by a door opening operation of the outside handle 102.

First locking/unlocking mechanism 6 is disposed in the body 2, and switchable between an unlocked state where the door opening operation of the outside handle 102 is effective, and a locked state where the door opening operation thereof is ineffective. The first locking/unlocking mechanism 6 includes a locking/unlocking lever 8 pivotally attached to an upper part of the body 2 by a shaft 7, and a sub-lever 9 having its lower part pivotally attached to the outside lever 4 by a shaft 9*a*, and its upper part connected through an oblong hole 9*b* to the locking/unlocking lever 8.

In the locked state of the first locking/unlocking mechanism 6, the locking/unlocking lever 8 and the sub-lever 9 are in locking positions shown in FIG. 4, respectively, and even when the sub-lever 9 are moved downward through the outside lever 4 by the door opening operation of the outside handle 102, a releasing portion 9*c* provided in the sub-lever 9 is not engaged with a first engaging portion 3*a* of the open lever 3, i.e. the releasing portion 9*c* passes by the first engaging portion 3*a* without abutting thereon, thus disabling the door opening.

In the unlocked state of the first locking/unlocking mechanism 6, in FIG. 4, the locking/unlocking lever 8 is in an unlocking position rotated counterclockwise from the locking position by a predetermined amount, and the sub-lever 9 is in an unlocking position rotated clockwise from the locking position by a predetermined amount. When the sub-lever 9 is moved downward through the outside lever 4 by the door opening operation of the outside handle 102, the releasing portion 9*c* of the sub-lever 9 is engaged with the first engaging portion 3*a* of the open lever 3 to rotate the open lever 3 in the opening direction, thus enabling the door opening.

Figure 5:
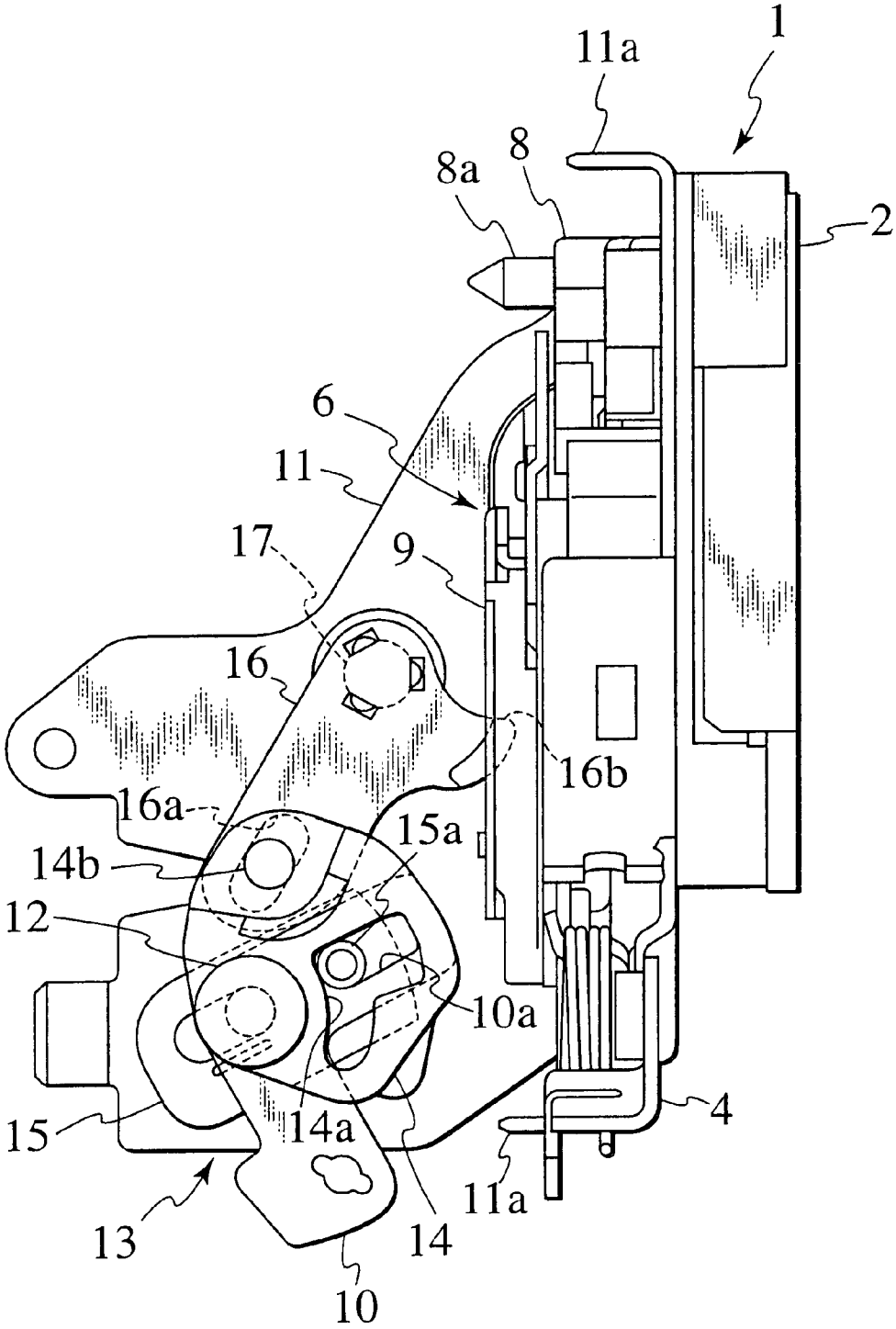
FIG. 5 is a side view of the door lock assembly viewed from a direction indicated by an arrow V in FIG. 4, showing a second locking/unlocking mechanism in its locked state.

In FIG. 5, an inside lever 10 is pivotally attached to a base plate 11 of the body 2 by a shaft 12 with its end directed toward inside the car. A lower end of the inside lever 10 is connected through a cable (not shown) to an inside handle 103 provided inside the car door 101. The inside lever 10 is rotated in an opening direction (clockwise direction in FIG. 5) by a door opening operation of the inside handle 103.

Second locking/unlocking mechanism 13 is switchable between an unlocked state where the door opening operation of the inside handle 103 is effective, and a locked state where the door opening operation thereof is ineffective. The second locking/unlocking mechanism 13 includes a connecting lever 14 pivotally attached to the inside lever 10 by the shaft 12, and a switching lever 15 supported by the shaft 12 so as to be rotatable and slidable back and forth.

Figure 6:
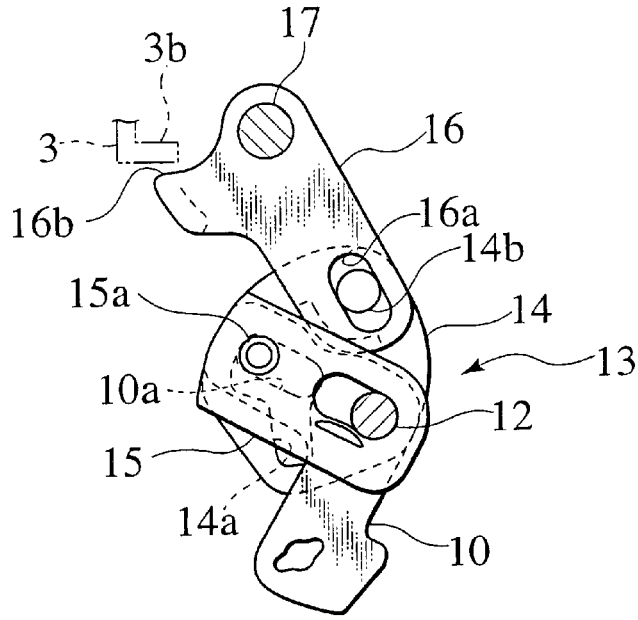
FIG. 6 is a side view of the second locking/unlocking mechanism in its unlocked state, viewed from the inside of the car.
Figure 7:
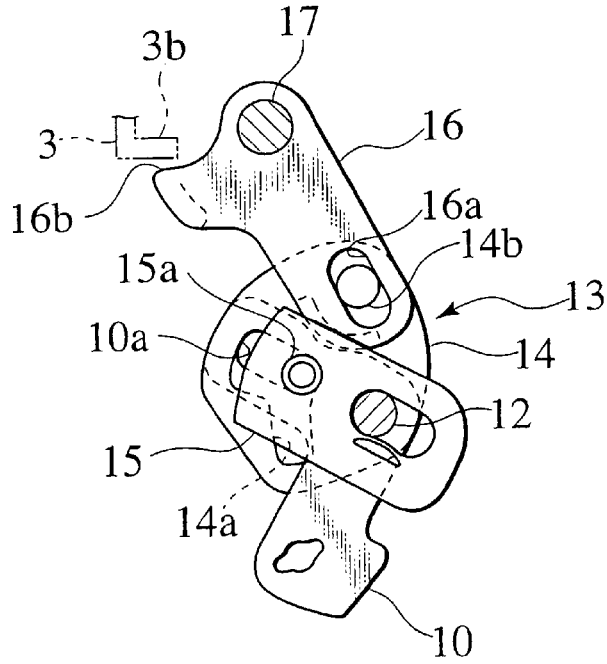
FIG. 7 is a side view of the second locking/unlocking mechanism in its locked state, viewed from the inside of the car.

The switching lever 15 has, on an end thereof, a shaft-shaped connecting portion 15*a* with its end directed toward outside the car, slidably fitted to an oblong hole 10*a* provided in the inside lever 10 and an L-shaped groove 14*a* provided in the connecting lever 14. The connecting portion 15*a* of the switching lever 15 can be moved to a rear end of the L-shaped groove 14*a* as shown in FIG. 6, which is an unlocking position for enabling a coupling of the inside lever 10 with the connecting lever 14, and to a corner of the L-shaped-groove 14*a* as shown in FIGS. 5 and 7, which is a locking position for disabling the coupling thereof.

An override lever 16 is pivotally attached to the base plate 11 by a shaft 17 directed toward inside the car and has an oblong hole 16*a* provided in a lower part thereof, into which a connection shaft 14*b* provided in the connecting lever 14 is slidably and rotatably fitted. By rotating the override lever 16 in an opening direction (counterclockwise direction in FIG. 5), a releasing portion 16*b* provided in an end thereof is engaged with a second engaging portion 3*b* of the open lever 3, and the open lever 3 can be rotated in the opening direction.

In the unlocked state of the second locking/unlocking mechanism 13, the switching lever 15 positions at the unlocking position, the inside lever 10 can be coupled with the connecting lever 14 and the override lever 16, and even when the first locking/unlocking mechanism 6 is in the locked state, the door 101 can be opened by the door opening operation of the inside handle 103, i.e., an override operation.

In the locked state of the second locking/unlocking mechanism 13, the switching lever 15 positions at the locking position, and even when the inside lever 10 is rotated in the opening direction by the door opening operation of the inside handle 103, the connecting portion 15*a* of the switching lever 15 moves inside a portion of the L-shaped groove 14*a* from the corner thereof to a lower end thereof, which extends along a circular arc about a center of the shaft 12, and does not transfer the rotation of the inside lever 10 about the shaft 12 to the connecting lever 14. Consequently, the override lever 16 cannot be rotated in the opening direction, thus disabling the override operation by the inside handle 103.

Figure 2:
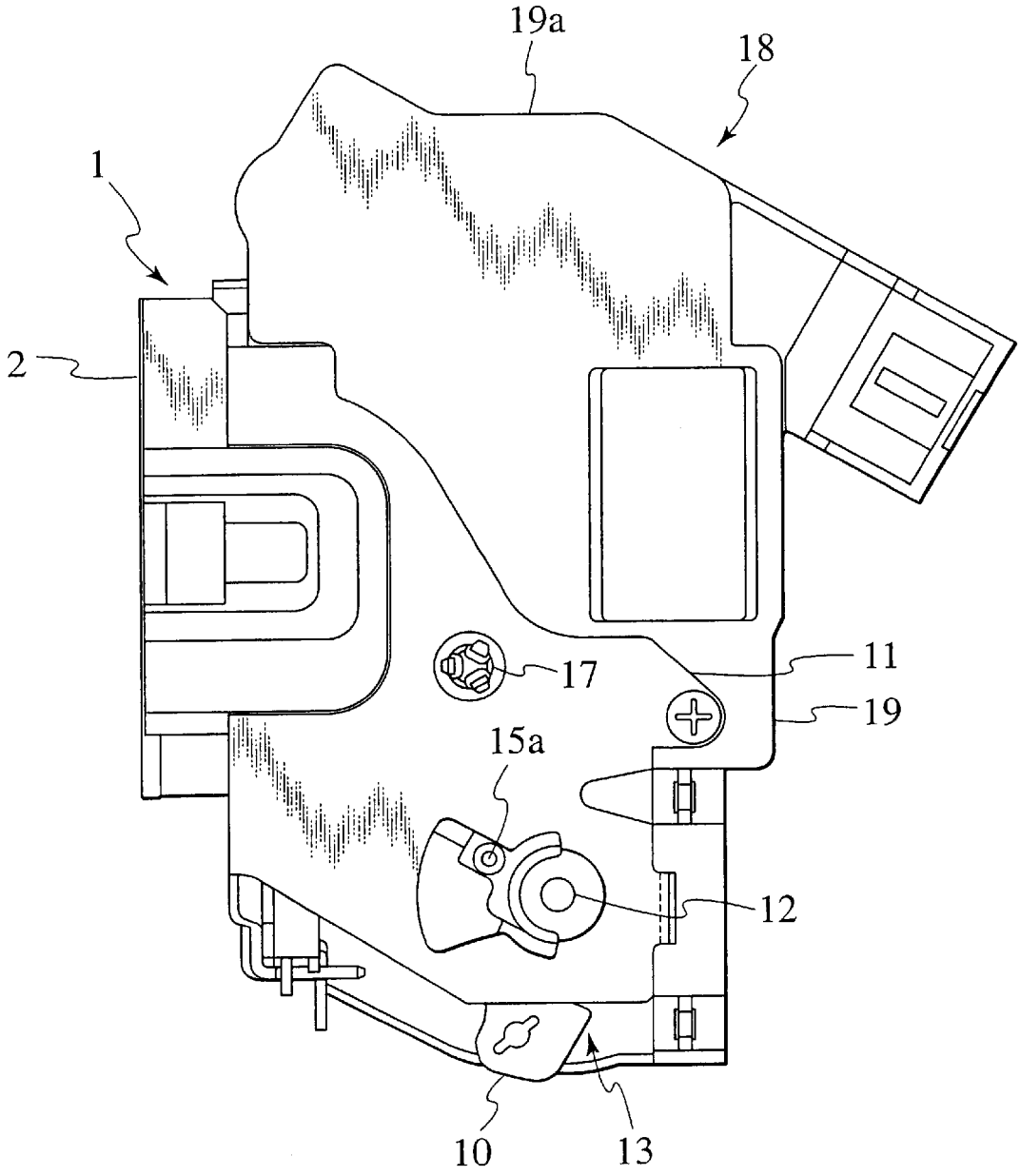
FIG. 2 is a side view of the door locking apparatus, showing a door lock assembly and an actuator thereof being coupled together.

An actuator 18 is attached to the base plate 11 of the door lock assembly 1 as shown in FIG. 2, and in its housing 19, first and second driving mechanisms 20 and 21 and third locking/unlocking mechanism 22 are provided.

The housing 19 is fixed to the base plate 11 by engagement of a plurality of claws 11*a* provided in the base plate 11 therewith, and houses components of the actuator 18, and functions as a waterproof and antitheft cover for the door lock assembly 1. A nearly upper half of the housing 19 is closed by a cover 19*a*.

The first driving mechanism 20 includes: a first motor 23 rotatable in a predetermined direction operated by control switches such as an in-car control switch 104 provided near a driver's seat, for example on an arm rest the car door close to switches for opening/closing windows as shown in FIG. 1, and a remote control switch 105 incorporated in a key or the like; and a first driving lever 24 supported on the housing 19 so as to be slidable in an up-and-down direction.

Figure 3:
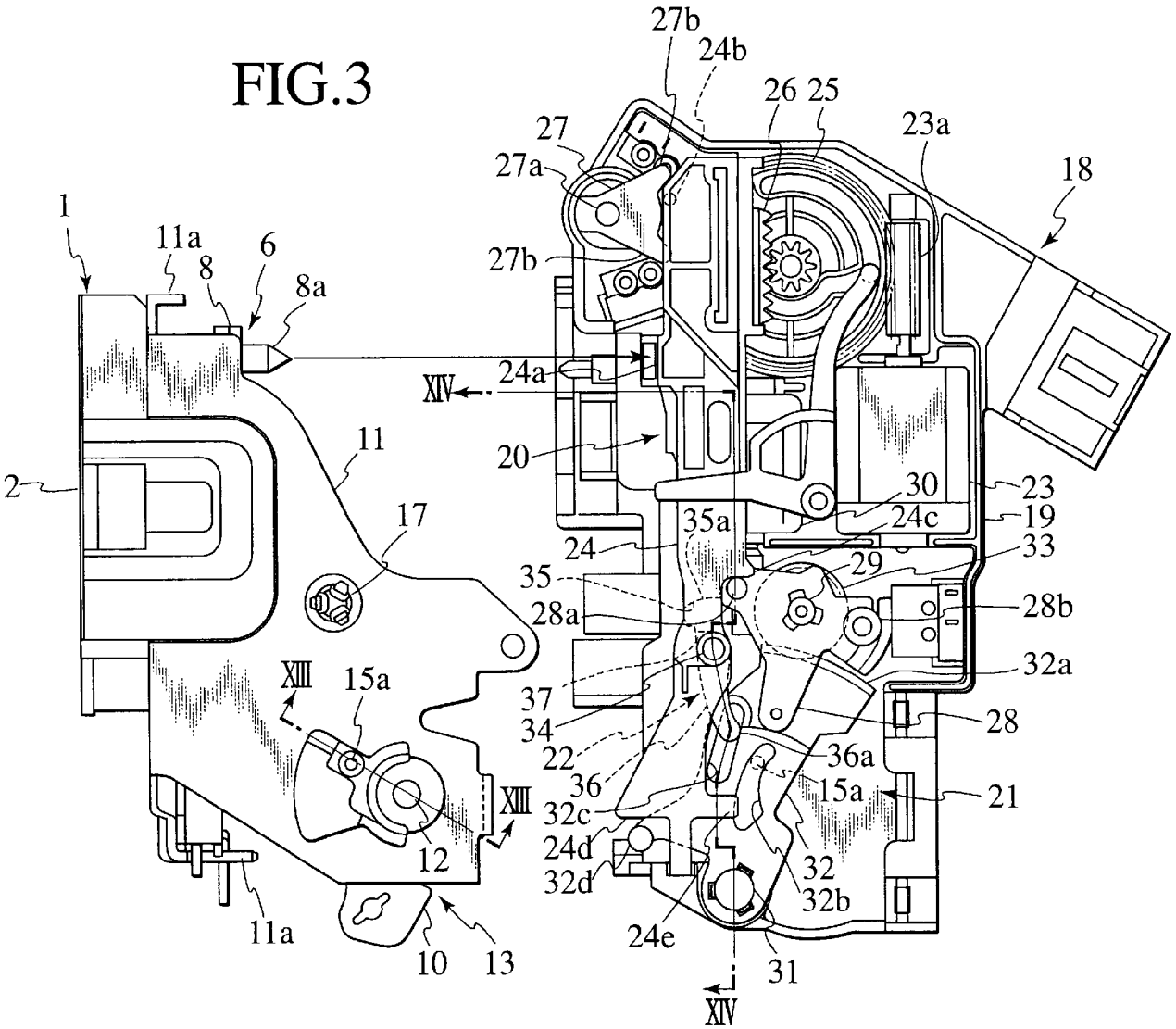
FIG. 3 is a side view of the door locking apparatus before the door lock assembly and the actuator are coupled, showing first and second driving mechanisms being at locking positions and a third locking/unlocking mechanism being in locked state.
Figure 8:
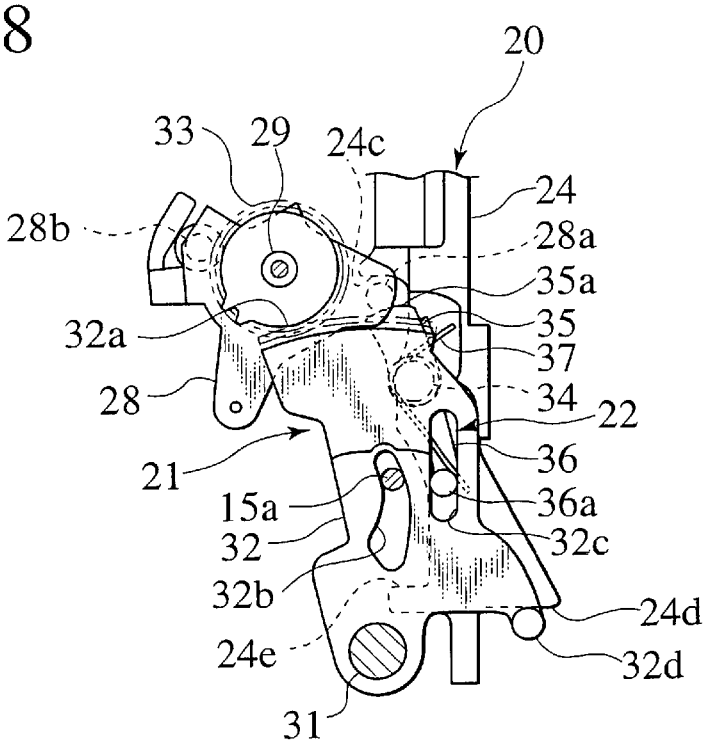
FIG. 8 is a side view of the first and second driving mechanisms being at unlocking positions and the third locking/unlocking mechanism being in unlocked states, viewed from an outside of the car.
Figure 9:
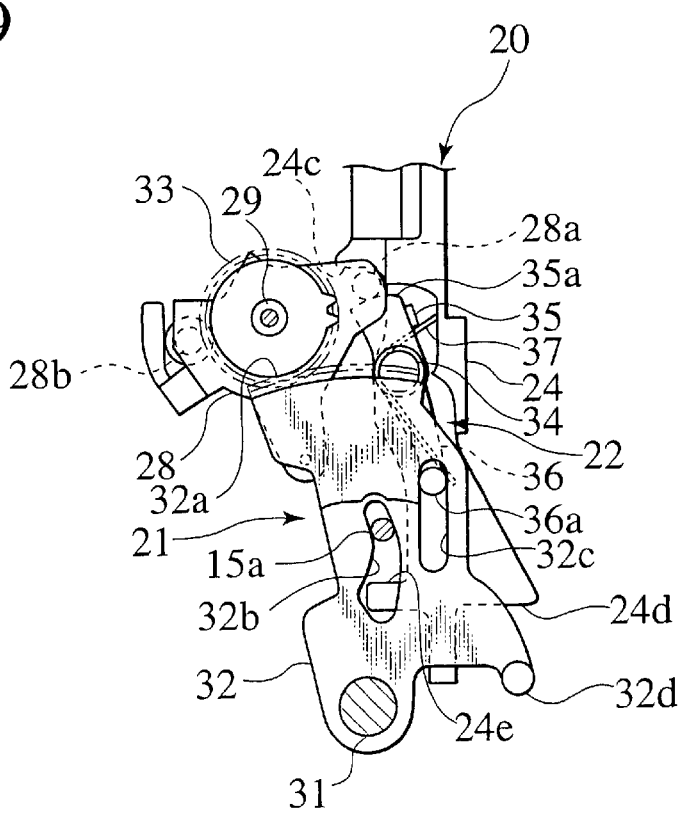
FIG. 9 is a side view of the first driving mechanism being at its locking position, the second driving mechanism being at its unlocking position and the third locking/unlocking mechanism being in its unlocked state, viewed from the outside of the car.

By the first motor 23, through a worm 23*a* fixed to a rotary shaft of the first motor 23, a worm wheel 25 engaged with the worm 23*a*, and a rack 26 engaged with the worm wheel 25 and supported by an upper part of the first driving lever 24 so as to be slidable up and down, the first driving lever 24 can be moved in an upward direction, i.e. an unlocking direction, from its locking position shown in FIGS. 3 and 9 to its unlocking position shown in FIG. 8, or can be moved in a downward direction, i.e. a locking direction, reverse 6 thereto.

The first driving lever 24 has a connection hole 24*a* provided approximately in the middle of the longitudinal direction thereof, into which a connecting portion 8*a* provided in an end of the locking/unlocking lever 8 is inserted. By moving the first driving lever 24 to the locking and unlocking positions, the first locking/unlocking mechanism 6 can be switched between its locked and unlocked states.

A key lever 27 is pivotally attached to the upper part of the housing 19 by a shaft 27*a* directed toward outside the car, and receives an operational force of a mechanical key cylinder 106 provided outside the car door 101. This key lever 27 has a pair of upper and lower arms 27*b* to be engaged with a protrusion 24*b* provided in an upper part of the first driving lever 24 from top or bottom thereof.

When the key lever 27 is rotated from its neutral position shown in FIG. 3 to its unlocking direction (clockwise direction in FIG. 3) by an unlocking operation of the key cylinder 106, the upper arm 27*b* is engaged with the protrusion 24*b* of the first driving lever 24 to move the first driving lever 24 in the unlocking direction. Similarly, when the key lever 27 is rotated from the neutral position to its locking direction (counterclockwise direction in FIG. 3) by a locking operation of the key cylinder 106, the lower arm 27*b* is engaged with the protrusion 24*b* to move the first driving lever 24 in the locking direction.

A knob lever 28 is pivotally attached to the housing 19 by a shaft 29 directed toward outside the car. The knob lever 28 is connected through a cable (not shown) to a locking/unlocking knob 107 (as a knob) provided inside the car door 101, and can be rotated to its unlocking position shown in FIG. 8 and to its locking position shown in FIG. 9.

A protrusion 28*a* as a connecting portion provided in an end of the knob lever 28 can be engaged with an engaging portion 24*c* provided in the first driving lever 24 so as to move the first driving lever 24 in the locking direction when the knob lever 28 is rotated in its locking direction (clockwise direction in FIG. 3).

The rotation range of the knob lever 28 is restricted by abutting of an abutting portion 28*b* on a stopper (not shown) provided in the cover 19*a*, the abutting portion 28*b* being provided in an end of the knob lever and having an elastic body fitted over.

The second driving mechanism 21 includes a second motor 30 rotatable in a predetermined direction by an operation of the remote control switch 105, and a second driving lever 32 pivotally attached to the lower part of the housing 19 by a shaft 31 directed toward outside the car.

Figure 10:
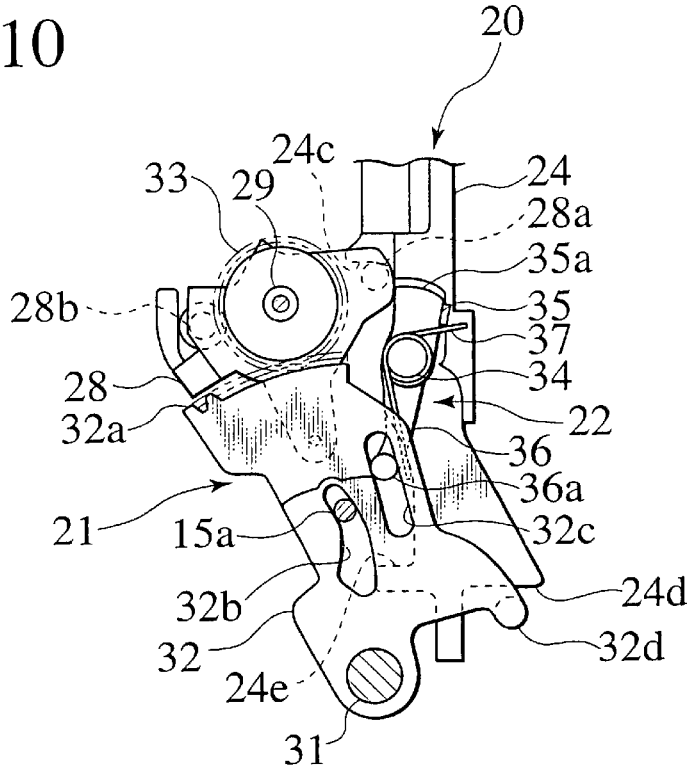
FIG. 10 is a side view of the first and second driving mechanisms being at locking positions and the third locking/unlocking mechanism being in locked state, i.e. double-locked state, viewed from the outside of the car.
Figure 14:
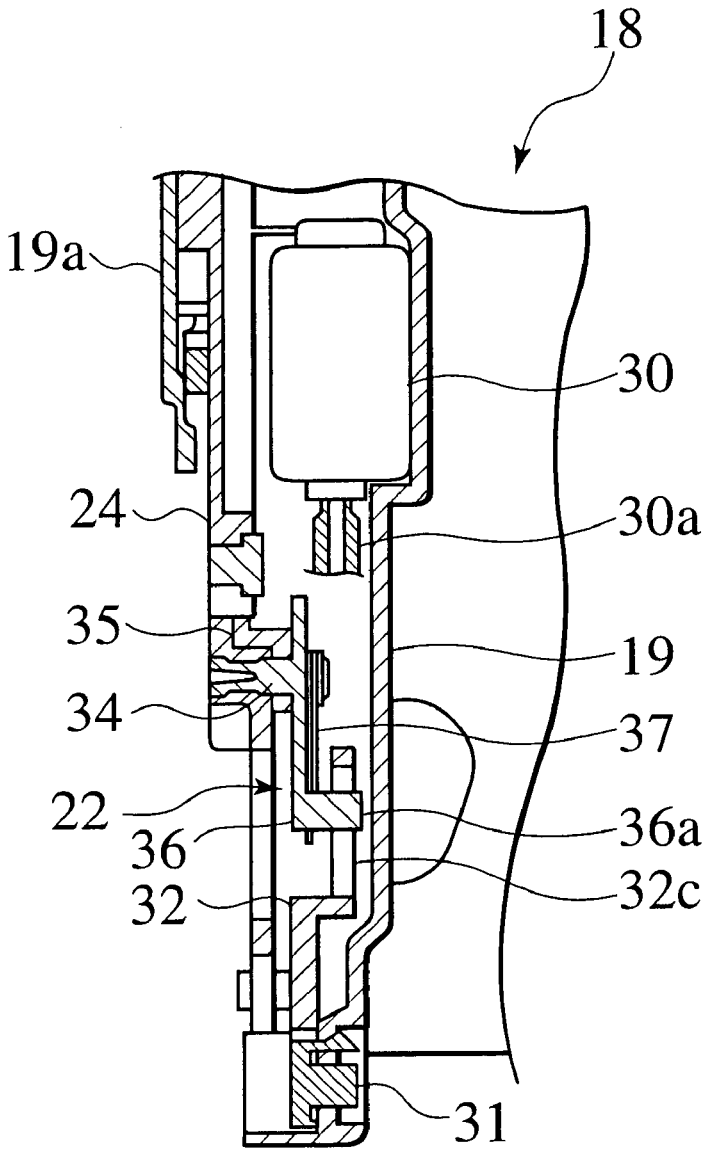
FIG. 14 is a fragmentary sectional view taken along a line XIV—XIV of FIG. 3.

By the second motor 30, through a worm 30*a* fixed to a rotary shaft of the second motor 30, a worm wheel 33 engaged with the worm 30*a* (FIG. 14) and pivotally attached to the shaft 29 of the knob lever 28, and a tooth portion 32*a* engaged with the worm wheel 33, the second driving lever 32 can be rotated from its locking position shown in FIGS. 3 and 10 to its unlocking position shown in FIGS. 8 and 9, or can be rotated in a direction reverse thereto.

The connecting portion 15*a* of the switching lever 15 in the second locking/unlocking mechanism 13 and the third locking/unlocking mechanism 22 are slidably engaged with the second driving lever 32, respectively through a vertically oblong hole 32*b* provided approximately in the middle of the second driving lever 32 and a vertically oblong hole 32*c* provided above the oblong hole 32*b*.

The second driving lever 32 can switch the second locking/unlocking mechanism 13 from its locked state to its unlocked state when rotated from the locking position to the unlocking position by the second motor 30, and can switch the second locking/unlocking mechanism 13 from the unlocked state to the locked state when rotated from the unlocking position to the locking position.

When the first driving lever 24 is moved from the locking position to the unlocking position by a manual operation through the key cylinder 106, the engaging portion 24*d* provided in a lower end of the first driving lever 24 is abutted on a protrusion 32*d* of the second driving lever 32, and accordingly, the second driving lever 32 in the locking position can be rotated to the unlocking position.

The third locking/unlocking mechanism 22 is pivotally attached to the first driving lever 24 by a shaft 34 directed toward inside the car. The third locking/unlocking mechanism 22 includes: an upper first lever 35 having in its upper end an engaging portion 35*a* capable of engaging with the protrusion 28*a* of the knob lever 28; and a lower second lever 36 pivotally attached to the same shaft 34 as the first lever 35, the lower second lever 36 having a connection portion 36*a* provided in its end and slidably engaged with the oblong hole 32*c* of the second driving lever 32. By rotating the second driving lever 32, the third locking/unlocking mechanism 22 can be switched between its unlocked state shown in FIGS. 8 and 9 for enabling an operating force for unlocking of the locking/unlocking knob 107 to be transmitted to the first locking/unlocking mechanism 6, and its locked state shown in FIGS. 3 and 10 for disabling the transmission of the operating force for unlocking.

A spring 37 has one leg engaged with the first lever 35 and the other leg engaged with the second lever 36, and presses the first and second levers 35 and 36 in counterclockwise and clockwise directions in FIG. 8, respectively.

The second lever 36 can be rotated in the clockwise direction independently of the first lever 35 in FIG. 3. However, in the counterclockwise direction, the second lever 36 is coupled to the first lever 35 so as to be rotated integrally with the first lever 35.

In the unlocked state of the third locking/unlocking mechanism 22, when the knob lever 28 is rotated from the unlocking position to the locking position, the protrusion 28*a* is engaged with the engaging portion 24*c* of the first driving lever 24, and the first driving lever 24 is moved from the unlocking position to the locking position to set the first locking/unlocking mechanism 6 in the locked state, and when the knob lever 28 is rotated from the locking position to the unlocking position, the protrusion 28*a* is engaged with the engaging portion 35*a* of the first lever 35 in the third locking/unlocking mechanism 22, and the first driving lever 24 is moved from the locking position to the unlocking position to set the first locking/unlocking mechanism 6 in the unlocked state.

In the locked state of the third locking/unlocking mechanism 22, the engaging portion 35*a* of the first lever 35 is retreated to the outside of a rotation locus of the protrusion 28*a* of the knob lever 28. Thus, even when the knob lever 28 is rotated from the locking position to the unlocking position by operating the locking/unlocking knob 107, the protrusion 28*a* is not engaged with the engaging portion 35*a*. As a result, the first locking/unlocking mechanism 6 cannot be switched from the locked state to the unlocked state.

Next, description will be made for operations according to the embodiment of the present invention, in the following cases: case A in which the first, second and third locking/unlocking mechanisms 6, 13 and 22 are all in UNLOCKED state; case B in which the first locking/unlocking mechanism 6 is in LOCKED state, the second and third locking/unlocking mechanisms 13 and 22 are in UNLOCKED state; and case C in which the first, second and third locking/unlocking mechanisms 6, 13 and 22 are all in LOCKED state.

Case A

In the case A, the door 101 can be opened by the door opening operations of both outside and inside handles 102, 103. By the door opening operation of the outside handle 102, the door 101 can be opened by rotating the open lever 3 in the opening direction through the outside lever 4 and the sub-lever 9. By the door opening operation of the inside handle 103, the door 101 can be opened by rotating the open lever 3 in the opening direction through the inside lever 10, the switching lever 15 in the unlocking position, the connecting lever 14 and the override lever 16.

When a locking operation is carried out by the key cylinder 106 outside the car, the in-car locking/unlocking knob 107 inside the car, or the in-car control switch 104, the first driving lever 24 is moved from the unlocking position shown in FIG. 8 to the locking position shown in FIG. 9, and the first locking/unlocking mechanism 6 can be switched from the unlocked state to the locked state.

When a locking operation is carried out by the remote control switch 105, the first and second driving levers 24 and 32 are moved from the unlocking positions to the locking positions by the first and second motors 23 and 30, respectively, and the first and second locking/unlocking mechanisms 6 and 13 are switched from the unlocked states to the locked states, respectively. Simultaneously, the third locking/unlocking mechanism 22 is switched from the unlocked state to the locked state by the second driving lever 32.

By the locking operation of the remote control switch 105, the first, second and third locking/unlocking mechanisms 6, 13 and 22 can all be set in the locked states, achieving a so-called double-locked state.

Case B

In the case B, the door 101 cannot be opened by the door opening operation of the outside handle 102. However, in the door opening operation of the inside handle 103, the door 101 can be opened by an override operation.

When the switching lever 15 in the unlocking position is rotated in the opening direction by the override operation, the connecting portion 15*a* of the switching lever 15 is abutted on an arm 24*e* provided in the first driving lever 24 from above, making it possible to forcibly move the first driving lever 24 from the locking position to the unlocking position. Thus, the first locking/unlocking mechanism 6 can be switched from the locked state to the unlocked state.

Case C

Case C is a double-locked state where the door opening operations of the outside and inside handles 102, 103 and the unlocking operation of the locking/unlocking knob 107 are ineffective.

In this double-locked state, the door 101 cannot be opened by the door opening operations of the outside and inside handles 102, 103. In addition, even when the locking/unlocking knob 107 is illegally operated for unlocking, the protrusion 28*a* of the knob lever 28 is not engaged with the engaging portion 35*a* of the first lever 35 in the third locking/unlocking mechanism 22 in the locked state, thus disabling the first locking/unlocking mechanism 6 from being set in the unlocked state.

When an unlocking operation is carried out by the remote control switch 105 to release the double-locked state, the second driving lever 32 is rotated from the locking position to the unlocking position by the second motor 30, and the second and third locking/unlocking mechanisms 13 and 22 are switched to the unlocked states, respectively. Then, by the first motor 23, the first driving lever 24 is moved from the locking position to the unlocking position, and the first locking/unlocking mechanism 6 is switched to the unlocked state. Accordingly, the double-locked state is released.

Moreover, in the double-locked state, even when the unlocking operation by the remote control switch 105 to release the double-locked state is disabled due to a dead battery or the like, the double-locked state can be released by an unlocking operation of the key cylinder 106, in which the unlocking operation thereof moves the first driving lever 24 from the locking position to the unlocking position, with the first locking/unlocking mechanism 6 being switched to the unlocked state. At the same time, the engaging portion 24*d* of the first driving lever 24 abuts on the protrusion 32*d* of the second driving lever 32, and the second driving lever 32 is then rotated from the locking position to the unlocking position. Accordingly, the second locking/unlocking mechanism 13 can be switched to the unlocked state.

Figure 11:
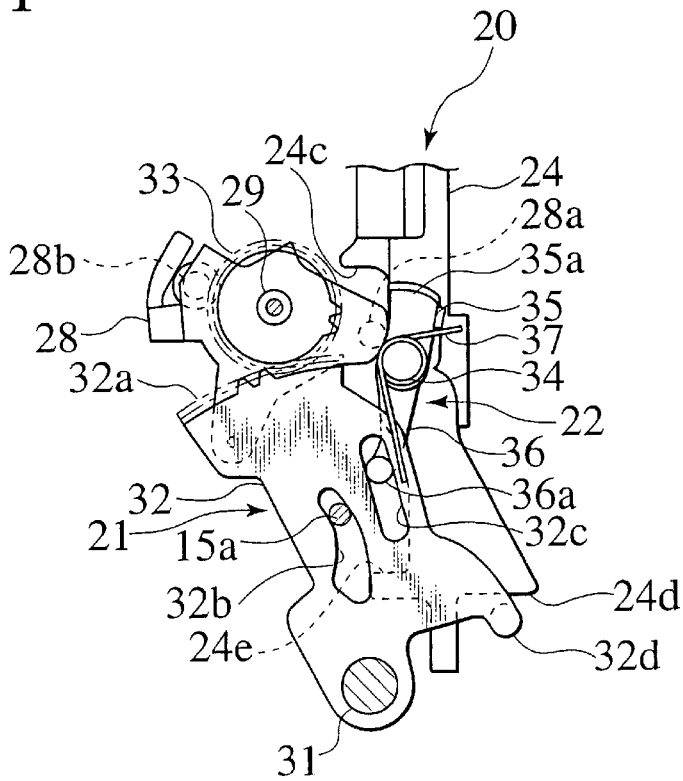
FIG. 11 is a side view of the first and second driving mechanisms and the third locking/unlocking mechanism being in the double-locked state as in FIG. 10, with a knob lever being rotated to its unlocking position.

In the double-locked state, even when the locking/unlocking knob 107 is illegally operated for unlocking, the protrusion 28*a* of the knob lever 28 moved to the unlocking position interferes with the first lever 35 of the third locking/unlocking mechanism 22 in the locked state as shown in FIG. 11, and a shift of the third locking/unlocking mechanism 22 to the unlocked state is disturbed, the double-locked state can be released by the unlocking operation of the remote control switch 105.

Figure 12:
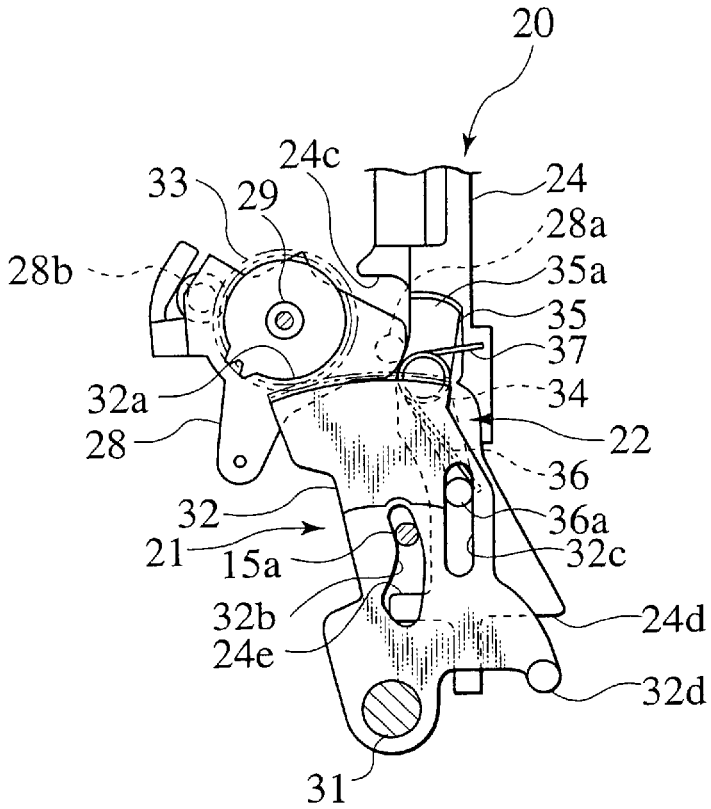
FIG. 12 is a side view of the first and second driving mechanisms, the third locking/unlocking mechanism, and the knob lever of the FIG. 11, with the second driving mechanism rotated to its unlocking position.
Figure 13:
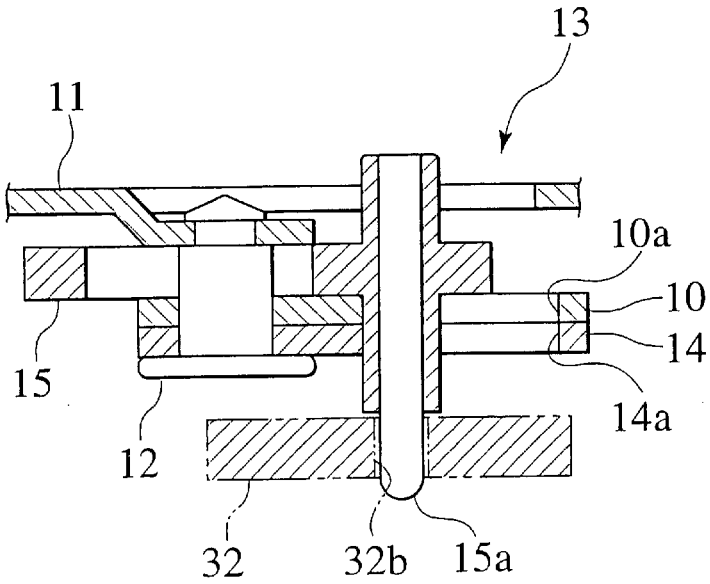
FIG. 13 is a fragmentary sectional view taken along a line XIII—XIII of FIG. 3.

That is, in the state of FIG. 11, when the second driving lever 32 is moved from the locking position to the unlocking position by the second motor 30, the second lever 36 of the third locking/unlocking mechanism 22 is accordingly rotated to its position shown in FIG. 12 against a pressing force of the spring 37. Subsequently, when the first driving lever 24 is moved from the locking position to the unlocking position by the first motor 23, the interference between the first lever 35 and the knob lever 28 is released, the first lever 35 is moved to the unlocking position by the spring 37, and the third locking/unlocking mechanism 22 is switched to the unlocked state.

The invention may be practiced or embodied in other ways without departing from the sprit or essential character thereof. The preferred embodiment described herein is therefore illustrative and not restrictive, the scope of the invention being indicated by the claims, and all variations which come within the meaning of claims are intended to be embraced herein.

What is claimed is:

1. A door locking apparatus for a vehicle, comprising:

a first driving mechanism operable by a knob provided inside a car and a control switch;

a first locking/unlocking mechanism driven by the first driving mechanism, being switchable between an unlocked state where operations of an outside handle provided outside the car and an inside handle provided inside the car are effective, and a locked state where the operation of the outside handle is ineffective while the operation of the inside handle being effective;

a second driving mechanism operable by the control switch;

a second locking/unlocking mechanism driven by the second driving mechanism, being switchable between an unlocked state where the operation of the inside handle is effective, and a locked state where the operation of the inside handle is ineffective; and a third locking/unlocking mechanism being switchable between an unlocked state for enabling a transmission of an operating force for unlocking from the knob to the first locking/unlocking mechanism, and a locked state for disabling the transmission thereof, wherein the first driving mechanism comprises:

a first motor operable by the control switch; and a first driving lever connected to the first locking/unlocking mechanism, being operated by one of the first motor and a knob lever connected to the knob and movable between an unlocking position for setting the first locking/unlocking mechanism in the unlocked state and a locking position for setting the first locking/unlocking mechanism in the locked state, the second driving mechanism comprises:

a second motor operable by the control switch; and a second driving lever connected to the second locking/unlocking mechanism, being operated by the second motor and movable between an unlocking position for setting the second locking/unlocking mechanism in the unlocked state and a locking position for setting the second locking/unlocking mechanism in the locked state, and the third locking/unlocking mechanism is attached to the first driving lever and is capable of being switched between the unlocked and locked state by the second driving lever.

2. The door locking apparatus for a vehicle according to claim 1, wherein the first driving lever can be moved from the locking position to the unlocking position by a key cylinder provided outside the car, and the moved first driving lever can switch the second locking/unlocking mechanism from the locking position to the unlocking position.

3. The door locking apparatus for a vehicle according to claim 1, wherein the knob lever is configured with a connecting portion for being connected to the first driving lever, the third locking/unlocking mechanism is configured with an engaging portion to be engaged with the connecting portion, and in an unlocking operation of the knob, with the third locking/unlocking mechanism in the unlocked state, the connecting portion is engaged with the engaging portion to move the first driving lever from the locking position to the unlocking position, and with the third locking/unlocking mechanism in the locked state, the connecting portion is not engaged with the engaging portion so that the first driving lever is disabled from moving from the locking position to the unlocking position.

4. The door locking apparatus for a vehicle according to claim 1, wherein the knob lever is configured with a connecting portion for being connected to the first driving lever, and the third locking/unlocking mechanism comprises:

a first lever pivotally attached to the first driving lever, having an engaging portion provided in an end thereof to be engaged with the connecting portion of the knob lever, and being movable between an unlocking position for enabling the engaging portion to be engaged with the connecting portion of the knob lever and a locking position for disabling the engagement, a second lever pivotally attached to the first driving lever, having a connection portion to be connected to the second driving lever, and being coupled to the first lever so that the second driving lever can move from the locking position to the unlocking position even when the first lever is in the locking position, and a spring provided between the first and second levers, for pressing the first lever from the locking position to the unlocking position.

* * * * *